US007297937B2

(12) United States Patent
Charrier et al.

(10) Patent No.: US 7,297,937 B2
(45) Date of Patent: Nov. 20, 2007

(54) PHOTOELECTRIC DETECTOR

(75) Inventors: Pierre Charrier, Migne-Auxances (FR); Joël Gailledrat, Champniers (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 48 days.

(21) Appl. No.: 11/253,544

(22) Filed: Oct. 20, 2005

(65) Prior Publication Data

US 2006/0086911 A1 Apr. 27, 2006

(30) Foreign Application Priority Data

Oct. 22, 2004 (FR) ..... 04 52405

(51) Int. Cl.
*H01J 5/16* (2006.01)

(52) U.S. Cl. ..... 250/239; 250/216

(58) Field of Classification Search ..... 250/239, 250/221, 556

See application file for complete search history.

(56) References Cited

U.S. PATENT DOCUMENTS 4,507,654 A 3/1985 Stolarczyk et al.
5,266,797 A 11/1993 Zuefferey
5,793,037 A * 8/1998 Guillot ..... 250/239
5,811,798 A * 9/1998 Maurin ..... 250/239
6,642,510 B1 * 11/2003 Sugiyama ..... 250/239
6,921,893 B1 * 7/2005 Petschik ..... 250/221

* cited by examiner

*Primary Examiner*—Thanh X. Luu
*Assistant Examiner*—Tony Ko
(74) *Attorney, Agent, or Firm*—Oblon, Spivak, McClelland, Maier & Neustadt, P.C.

(57) ABSTRACT

A photoelectric detector includes an electronic card connected to an emit member and a receive member, the emit member emits at least a first light signal, and the receive member receives at least a second light signal reflected from the first light signal; a cap that includes an emit lens and a receive lens made of a translucent material and positioned in front of the emit member and the receive member, respectively; and a fixing support made of an opaque material to which the card and the cap are fixed. The support has a protruding central blade that is inserted into a separating slot in the cap, between the emit lens and the receive lens.

11 Claims, 2 Drawing Sheets

PHOTOELECTRIC DETECTOR

CROSS-REFERENCE TO RELATED APPLICATIONS

This application claims priority to French Patent Application No. 04 52405, filed Oct. 22, 2004, the entire contents of which are incorporated herein by reference.

BACKGROUND OF THE INVENTION

1. Field of the Invention

The present invention relates to a photoelectric detector that includes a member for emitting a light signal and a member for receiving a reflected light signal. The photoelectric detector outputs information indicative of the presence of a target to be detected or a distance to the target to be detected along a path of the light signal.

2. Discussion of the Background

Photoelectric detection devices are well known and can usually be divided into two categories. The first category includes systems that are called thru-beam type systems. The emit member and the receive member of these devices are placed at two points distanced apart and the target is detected when the target crosses a light signal between these two points. In the second category, the emit member and the receive member of the device are generally placed in the same casing. This second category includes systems that are called reflex systems (which may or may not use polarized light), in which a remote reflector can reflect the emitted light signal to the receive member in the absence of a target. Also, the second category includes systems that are called proximity systems (with or without background elimination) that operate using the diffuse reflection of the emitted light signal off the target to be detected.

In the second category, the emit and receive members are therefore very close to each other, in particular in the case of small photoelectric detectors. It is therefore necessary to prevent the phenomenon of crosstalk, i.e., the risk that might arise when the incoming and outgoing light rays become interchanged, which would greatly impair the reliability of the output information from the detector. Moreover, a photoelectric detector often includes lenses placed in front of the emit and receive members in order to improve their sensitivity and their performance and these lenses also increase the risk of crosstalk. Likewise, slight positioning discrepancies between the various members of the detector and a dispersion in the tolerance values from one manufacturing batch to another may increase the crosstalk phenomenon.

SUMMARY OF THE INVENTION

According to one aspect of the present invention a simple and inexpensive photoelectric detector is provided that makes possible for the incoming and outgoing light rays of the photoelectric detector to be satisfactorily isolated from each other within a small space. According to another aspect of the present invention it is possible to position the various elements of the detector with respect to one another to be effective and reliable, and easily reproducible on an industrial scale over time, so as to ensure a correct operation of the manufactured detectors.

One embodiment of the present invention describes a photoelectric detector that includes an electronic card, to which an emit member that emits at least a first light signal and a receive member that receives at least a second light signal reflected by the first light signal are fixed, and a cap that incorporates an emit lens and a receive lens made of translucent material and positioned in front of the emit member and the receive member, respectively. According to the embodiment of the present invention, the card and the cap are fixed to a fixing support made of an opaque material, the support having a protruding central blade that is inserted into a separating slot in the cap, between the emit lens and the receive lens.

According to another embodiment of the present invention, the support has a transverse base perpendicular to the central blade and includes a unit for fixing the electronic card. The central blade includes snap-fastening elements that cooperate with complementary elements on the cap in order to fix the cap to the support.

According to another embodiment of the present invention, the detector includes a translucent cover positioned over the emit and receive lenses, and the cover includes polarizing filters for the emitted and received light signals and the cover seals the slot in the cap.

BRIEF DESCRIPTION OF THE DRAWINGS

Other features and advantages will emerge from the detailed description that follows, with reference to an embodiment given by way of an example and represented in the appended drawings, in which.

DESCRIPTION OF THE PREFERRED EMBODIMENTS

Figure 8:
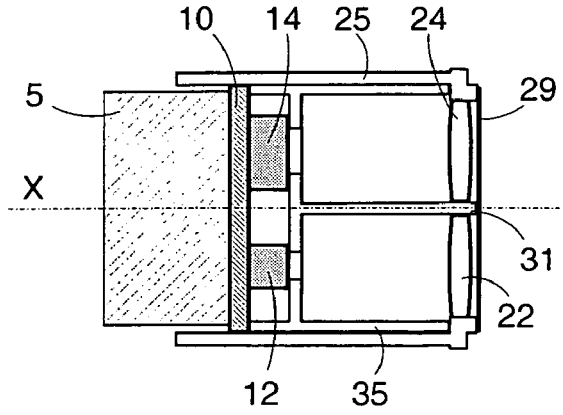
FIG. 8 is a simplified schematic view, in a longitudinal section, of the assembly formed by the cap, the support and the electronic card of the detector.

As shown in FIG. 8, a photoelectric detector, also called a photoelectric cell, includes an emit member 12 capable of emitting at least a first light signal in a direction approximately parallel to the longitudinal axis X of the detector, and a receive member 14 capable of receiving at least a second light signal. The received second light signal originates from the reflection of the emitted first light signal off a reflector or off a target (not shown) to be detected, depending on the use of the detector. The receive member 14 is provided with at least one photoreceptive component that can deliver an electrical signal representative of the second light signal.

The detector can operate either in a reflex detector mode or in a proximity detector mode. It can also operate in both of these modes. To do so, the emit member 12 may include a photoemissive component capable of emitting a light signal whose wavelength lies within the red spectrum, and a photoemissive component capable of emitting a light signal whose wavelength lies within the infrared spectrum. Likewise, the receive member 14 may include a photoreceptive component capable of receiving a light signal whose wavelength lies within the red spectrum, and a photoreceptive component capable of receiving a light signal whose wavelength lies within the infrared spectrum. The wavelength lying within the red spectrum is preferably used for operation in the reflex detector mode, and the wavelength lying within the infrared spectrum is preferably used for operation in the proximity detector mode.

Figure 2:
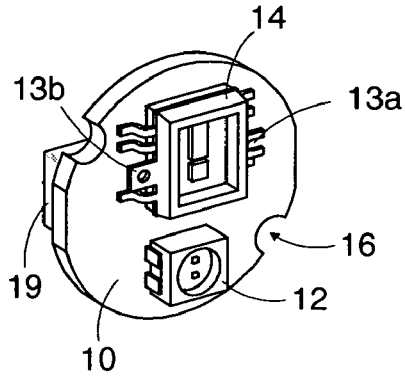
FIG. 2 shows an electronic daughter card bearing the receive and emit members of the detector.
Figure 7:
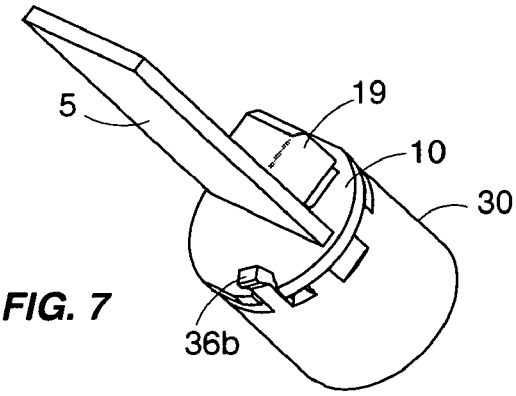
FIG. 7 shows the assembly of FIG. 1 without the cap.

The members 12 and 14 are soldered to an electronic card 10 of the detector, called a daughtercard, placed perpendicular to the X axis (see FIGS. 2, 7 and 8). The daughtercard 10 is connected to an electronic mothercard 5 of the detector, which in particular includes a unit for processing and analysing the electrical signal delivered by the receive member 14, for the purpose of delivering output information from the detector. The mothercard is placed longitudinally, on the X axis, and the connection between the daughtercard 10 and the mothercard 5 is for example provided by a connector 19 of the SMC type as shown in FIGS. 2 and 7. The connector 19 provides good electrical connection between the daughtercard 10 and the mothercard 5 and also relatively flexible mechanical linkage between the two cards 5 and 10.

Figure 1:
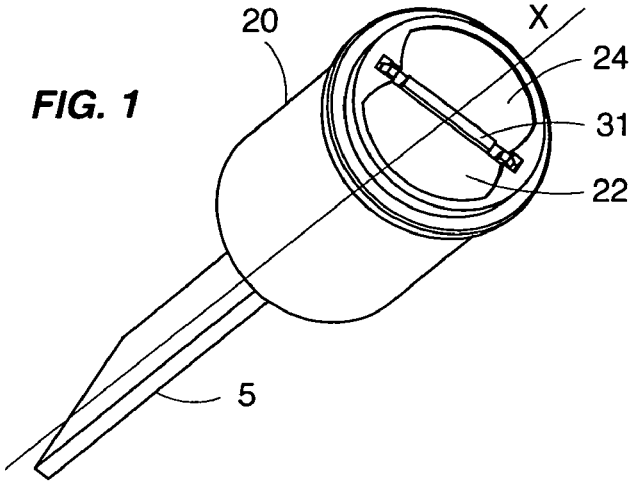
FIG. 1 shows the assembly formed from a cap and a fixing support for a detector, according to an embodiment of the present invention.
Figure 5:
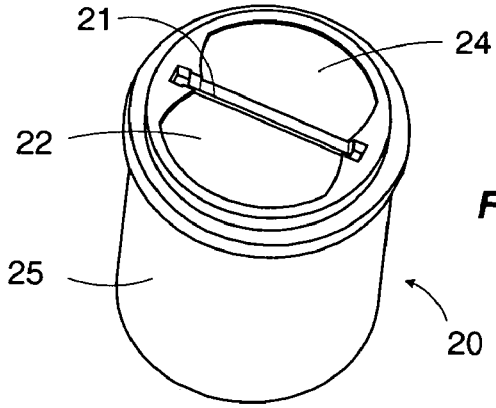
FIGS. 5 and 6 are two detailed views of the cap of the detector.
Figure 6:
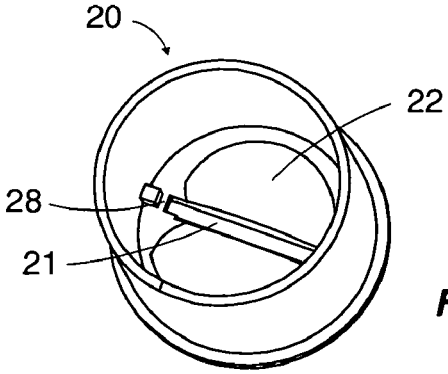

The detector also includes a cap 20 as shown in FIGS. 1, 5, and 6. The cap 20 is formed from a single part, including a longitudinal external skirt 25, having approximately the shape of a cylindrical tube as shown in FIG. 5, and an emit lens 22 and a receive lens 24 that are placed at one end of the cap 20, in a plane perpendicular to the X axis (see FIGS. 5 and 6). The emit lens 22 and receive lens 24 are made of translucent material and are positioned in front of the emit member 12 and receive member 14, respectively, so that the first light signal and the second light signal can pass respectively through them. Since the lenses 22 and 24 are formed by a single translucent part, the cap 20 has a separating slot 21 between the two lenses 22 and 24 over a large portion of the diameter of the cap, in order to isolate the light signals emitted and received by the detector.

According to one embodiment of the present invention, the detector also includes a fixing support 30 (see FIGS. 3 and 4) to which the card 10 and the cap 20 are fixed, thus providing a strong daughtercard 10/support 30/cap 20 assembly, while advantageously reducing the dimensions of the detector. This arrangement makes possible for the emit and receive members to be reliably and effectively positioned in all three dimensions relative to the emit and receive lenses, that is to say both in a transverse plane and in a longitudinal direction. In particular, this arrangement ensures that the emit and receive focal lengths remain very stable.

The support 30 includes a single part made of an opaque material. The support 30 has an approximately cylindrical longitudinal body 35 and a transverse base 39 perpendicular to the X axis (see FIGS. 3 and 4). The support 30 also has a protruding central blade 31 in a plane parallel to the X axis. The purpose of this central separating blade 31 is to ensure that the emitted and received light rays in the detector are effectively separate so as to avoid the risk of crosstalk between the emitted and received light rays. The central blade 31 is connected on each side to the inner wall of the cylindrical body 35. The central blade 31 bears at one end on the base 39, thus dividing the cap 30 into two approximately semicylindrical spaces that channel the light rays between the members 12 and 14 and the lenses 22 and 24.

At the other end, the blade 31 advantageously has a protrusion that is inserted into the separating slot 21 in the cap 20 when the latter is assembled with the support 30, so as to improve the separation between the emitted and received light rays, preventing any light dispersion caused by the lenses 22 and 24. Thus, according to this embodiment, the separation of the light rays is continuously maintained from the emit/receive members 12 and 14 right through to the emit/receive lenses 22 and 24.

Figure 3:
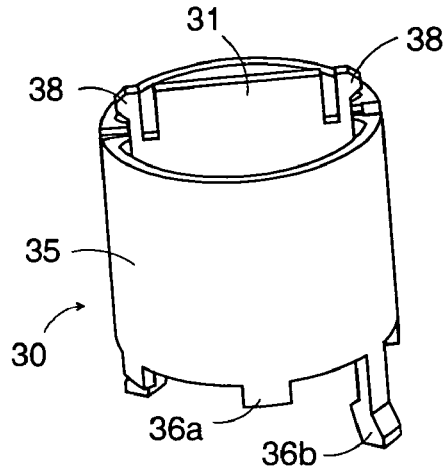
FIGS. 3 and 4 are two detailed views of the fixing support of the detector.
Figure 4:
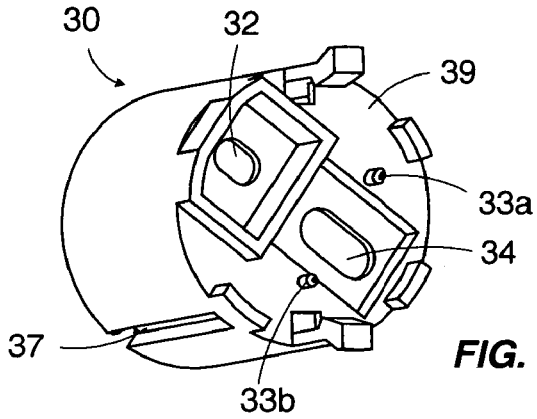

To ensure that the cap 20 is properly fixed to the support 30, according to one embodiment of the present invention a snap-fastening element 38 is placed on the central blade 31, and cooperates with a complementary element on the cap 20 (see FIGS. 3 and 6). These resilient snap-fastening elements are, for example, placed on each side of the blade 31 and cooperate with the corresponding edges of the slot 21.

Moreover, the cylindrical body 35 of the support 30 may have a longitudinal groove 37 into which a complementary feature on the skirt 25 of the cap 20 can be inserted when this cap is being fitted onto the support 30, serving as a polarizing slot and making the cap/support assembly more robust.

To ensure that the electronic card 10 is properly fixed to the support 30, one embodiment of the present invention provides a fixing element on the rear wall of the transverse base 39. The fixing element includes, for example, a snap-fastening device including a plurality of blocks 36*a*, distributed around the perimeter of the base 39 so as to ensure that the card 10 stays stably positioned in a transverse plane perpendicular to the X axis, and snap-fastening prongs 36*b* that cooperate with notches 16 in the card 10 so as to jam the card against the support 30 (see FIGS. 3 and 4).

The element for fixing the card 10 to the support 30 also includes a positioning device that prevents the card 10 from rotating about the X axis. This positioning device ensures that there is a correct alignment between the receive member 14 and the receive lens 24, for a good reception of the second light signal. The positioning device includes, for example, at least one stud 33*a* and 33*b* projecting from the external wall of the transverse base 39 and capable of being inserted into at least one corresponding notch 13*a* and 13*b* in the receive member 14 when the card 10 is fixed against the support 30 (see FIG. 4). In the present embodiment, the device has two studs 33*a* and 33*b* that are inserted into two notches 13*a* and 13*b* located on either side of the receive member 14.

This positioning device is particularly advantageous if the pins of the receive member 14 do not pass through the daughter board 10 but are only surface-mount soldered to the card 10, in which case there may be differences in the positioning of the receive member 14 depending on the manufacturing batch. Thus, the studs 33*a* and 33*b* always allow the position of the receive lens 24 to be dependent on the receive member 14.

The transverse base 39 has openings 32 and 34 on either side of the protruding blade 31, facing the emit 12 and receive 14 members so as to let through the emitted and received light signals. The base may also have, around the emit member 12 and receive member 14, features that allow a better mutual isolation of the light rays.

According to another embodiment of the present invention, the cap 20 and the support 30 may include only a single plastic part, which would then be produced by a two-shot injection moulding operation, using a translucent material and an opaque material. The opaque material is in fact needed for the protruding blade 31 and the body 35 of the support 30, while the translucent material is needed for the lenses 22 and 24 of the cap 20.

The detector also includes a translucent cover 29 (see FIG. 8) covering the lenses 22 and 24 and the slot 21 of the cap 20. This cover 29 is placed over the transverse external face of the cap 20 (see FIG. 8) and may include polarizing filters for the emitted and received light signals if the use of the detector so requires. The cover 29 also has the purpose of improving the sealing of the detector at the slot 21. It may also be fixed to the detector by ultrasonic welding onto a shoulder of the cap 20.

During manufacture of the detector, the daughtercard 10 is firstly fixed to the support 30. Next, the support 30/card 10 pre-assembly is introduced into the tube formed by the skirt 25 and is fixed to the cap 20 by the snap-fastening element 38. The mothercard 5 can then be connected to the daughtercard 10 by the connector 19, since this mothercard 5 is not involved in the proper positioning of the various elements of the daughtercard 10/cap 20/support 30 assembly. An overall outer casing (not shown in the figures) is then attached, in order to form the final detector. A sealing resin may also be introduced between the various elements in order to make the detector more robust.

Of course, it is possible, without departing from the scope of the invention, to conceive of other embodiments and improvements to the detail, and even to envisage the use of equivalent means.

The invention claimed is:

1. A photoelectric detector comprising:

an electronic card configured to connect to an emit member and a receive member, the emit member being configured to emit at least a first light signal, and the receive member being configured to receive at least a second light signal reflected from the first light signal;

a cap that includes an emit lens and a receive lens made of a translucent material and positioned in front of the emit member and the receive member, respectively; and a fixing support made of an opaque material to which the electronic card and the cap are fixed, wherein the fixing support has a protruding central blade that is inserted through a slot in the cap, between the emit lens and the receive lens.

2. The photoelectric detector according to claim 1, wherein the fixing support has a transverse base perpendicular to the central blade and includes means for fixing the electronic card.

3. The photoelectric detector according to claim 2, wherein the fixing means comprises:

a first device configured to snap-fasten the electronic card to the fixing support; and a second device configured to position the receive member relative to the receive lens.

4. The photoelectric detector according to claim 3, wherein the second device includes at least one stud on the transverse base of the fixing support that can be inserted into at least one corresponding notch in the receive member.

5. The photoelectric detector according to claim 1, wherein the central blade includes a snap-fastening element that cooperate with a complementary element in the cap in order to fix the cap onto the fixing support.

6. The photoelectric detector according to claim 2, wherein the fixing support also comprises an approximately cylindrical body perpendicular to the transverse base.

7. The photoelectric detector according to claim 1, further comprising:

a translucent cover positioned over the emit and receive lenses, and the cover includes polarizing filters for the emitted and received light signals and seals the slot of the cap.

8. The photoelectric detector according to claim 1, wherein the emit member comprises, a photoemissive component that emits a light signal in the red spectrum, and a photoemissive component that emits a light signal in the infrared spectrum; and wherein the receive member comprises, a photoreceptive component configured to detect in a reflex detector mode, and a photoreceptive component configured to detect in a proximity detector mode.

9. The photoelectric detector according to claim 1, wherein the cap and the fixing support are produced as a single part made by a two-shot injection moulding using a translucent material and an opaque material.

10. A photoelectric detector, comprising:

an electronic card configured to connect to an emit member and a receive member, the emit member being configured to emit at least a first light signal, and the receive member being configured to receive at least a second light signal reflected from the first light signal;

a cap that includes an emit lens and a receive lens made of a translucent material and positioned in front of the emit member and the receive member, respectively;

a fixing support made of an opaque material to which the electronic card and the cap are fixed; and a translucent cover positioned over the emit and receive lenses, and the cover includes polarizing filters for the emitted and received light signals and seals a separating slot of the cap, wherein the fixing support has a protruding central blade that is inserted into a separating slot in the cap, between the emit lens and the receive lens.

11. A photoelectric detector, comprising:

an electronic card configured to connect to an emit member and a receive member, the emit member being configured to emit at least a first light signal, and the receive member being configured to receive at least a second light signal reflected from the first light signal;

a cap that includes an emit lens and a receive lens made of a translucent material and positioned in front of the emit member and the receive member, respectively; and a fixing support made of an opaque material to which the electronic card and the cap are fixed, wherein the fixing support has a protruding central blade that is inserted into a separating slot in the cap, between the emit lens and the receive lens, the emit member comprises, a photoemissive component that emits a light signal in the red spectrum, and a photoemissive component that emits a light signal in the infrared spectrum, and the receive member comprises, a photoreceptive component configured to detect in a reflex detector mode, and a photoreceptive component configured to detect in a proximity detector mode.

* * * * *